United States Patent [19]

Minaminaka

[11] Patent Number: 4,832,517

[45] Date of Patent: May 23, 1989

[54] PRINTING APPARATUS WITH A TYPE WHEEL

[75] Inventor: Kazuyoshi Minaminaka, Suzuka, Japan

[73] Assignee: Brother Kogyo Kabushiki Kaisha, Nagoya, Japan

[21] Appl. No.: 95,020

[22] Filed: Sep. 10, 1987

[30] Foreign Application Priority Data

Sep. 11, 1986 [JP] Japan ..... 61-139583

[51] Int. Cl.[4] ..... B41J 1/26; B41J 29/36

[52] U.S. Cl. ..... 400/185; 400/144.2; 400/212; 400/697.1

[58] Field of Search ..... 400/144.2, 185, 187, 400/144.1, 144.4, 211, 212, 697.1

[56] References Cited

U.S. PATENT DOCUMENTS 4,239,400 12/1980 Giolitti ..... 400/144.2

4,637,744 1/1987 Valle et al. ..... 400/185

FOREIGN PATENT DOCUMENTS 2176747 1/1987 United Kingdom ..... 400/185

*Primary Examiner*—Edgar S. Burr

*Assistant Examiner*—James Lisehora

*Attorney, Agent, or Firm*—Jones, Tullar & Cooper

[57] ABSTRACT

A printing apparatus in which a cam member is connected to a type wheel by means of a rotating shaft so that the cam member rotates in a body with the wheel. The wheel is rotated by means of a motor for type selection. A pair of ribbon vibrators for supporting a correction ribbon are connected to the cam member by means of an operating plate attached to one of the vibrators. As the cam member rotates, a cam follower pin at the distal end portion of the operating plate alternatively engages one of first, second, and third cam portions formed on the cam member. In a normal printing operation, the correction ribbon is held in a nonprinting position, with the cam follower pin in the third cam portion, while the cam member is rotating in one direction. When the cam member rotates in the other direction, the pin is moved to the second cam portion via the first cam portion, so that the correction ribbon is held in a printing position. In this state, type selection and print correction are performed.

16 Claims, 3 Drawing Sheets

PRINTING APPARATUS WITH A TYPE WHEEL

BACKGROUND OF THE INVENTION

The present invention relates to a printing apparatus with a type wheel, such as a daisy wheel, having a number of types on the periphery thereof, in which a type bearing a character to be printed is set in a printing position by selective rotation of the wheel.

In conventional printing apparatuses of this kind, a motor for selectively rotating a type wheel having a number of types is provided independently of a drive source, such as a motor or solenoid, which is used to shift a ribbon, e.g., a correction ribbon, between an operative position and a nonoperative position.

In these prior art printing apparatuses, therefore, complicated drive mechanisms are required for type selection and ribbon shifting, thus entailing increase in manufacturing cost.

SUMMARY OF THE INVENTION

The present invention has been developed in consideration of these circumstances, and has an object to provide a printing apparatus, in which type selection and ribbon shifting are accomplished by rotating only one motor, so that drive mechanisms for these operations are simple in construction, thus ensuring relatively low manufacturing cost In order to achieve the above object, according to the present invention, cam means is rotated by the use of rotational drive means for type selection. The cam means, which includes at least first and second cam portions, is operatively connected, by means of coupling means, to ribbon supporting means which can move between first and second positions in order to shift the position of a ribbon. As the cam means rotates, the first cam portion thereof, in conjunction with the coupling means, causes the ribbon supporting means to move to the first position. Thus, the ribbon is moved from a nonprinting position to a printing position. As the cam means rotates, moreover, the second cam portion, in conjunction with the coupling means, holds the ribbon supporting means in the first position. Thus, the rotary drive means is allowed to select one among other types of the type wheel, with the ribbon held in the printing position.

With this arrangement, the type selection and ribbon shifting can be performed with use of a common drive means, so that drive mechanisms for these operations can be simplified in construction, thus permitting low-cost production.

Preferably, the rotational drive means is composed of a single drive motor for type selection.

Preferably, moreover, the cam means is further provided with a third cam portion, so that the ribbon supporting means is held in the second position by the third cam portion and the coupling means, as the cam means rotates. Thus, the rotational drive means is allowed to select one of the types of the type wheel, with the ribbon held in the nonprinting position. In this case, the ribbon is a correction ribbon.

In a specific arrangement, furthermore, the first, second, and third cam portions of the cam means are each formed of a cam groove. The first cam portion is connected to the second and third cam portions which extend individually along the circumferences of separate concentric circles around the axis of rotation of the cam means. A cam follower pin of the coupling means is adapted to selectively engage the cam grooves. Guide means are provided individually at a first coupling portion between the second cam portion and one end of the first cam portion, and at a second coupling portion between the third cam portion and the other end of the first cam portion. Only when the cam means rotates in a predetermined direction, do these guide means compulsorily guide the cam follower pin from the second cam portion to the first cam portion, or from the third cam portion to the first cam portion. When the cam means rotates reversely, the guiding action of the guide means is nullified, so that the cam follower pin continues to be held in the second or third cam portion.

With use of the cam means constructed in this manner, the printing apparatus of the invention can more easily be simplified in construction and reduced in size.

DETAILED DESCRIPTION OF THE PREFERRED EMBODIMENTS

A printing apparatus according to an embodiment of the present invention will now be described with reference to the accompanying drawings.

Figure 1:
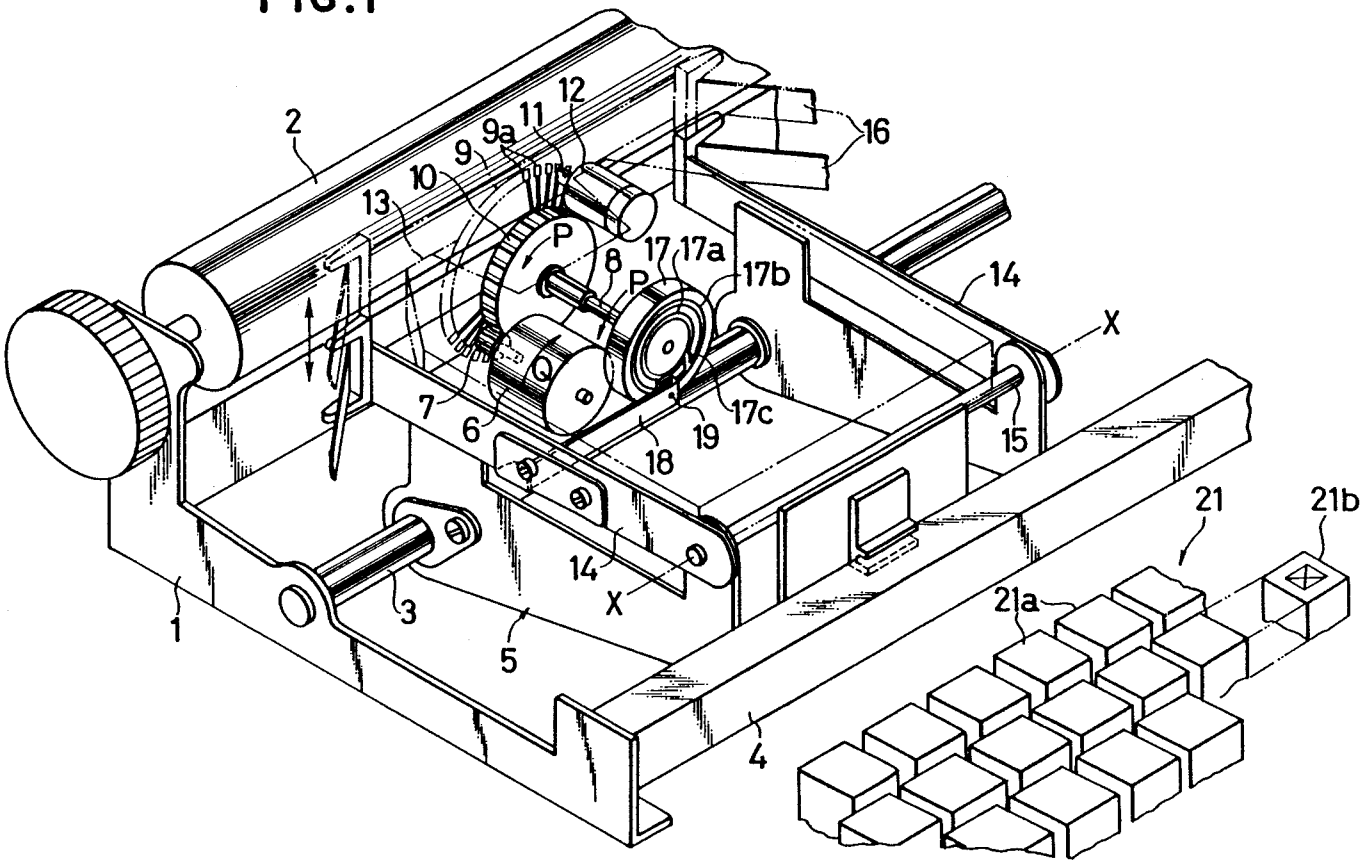
FIG. 1 is an external perspective view showing the principal mechanism of a printing apparatus according to an embodiment of the present invention.

As shown in FIG. 1, a platen 2 for supporting a printing sheet is rotatably mounted on the rear portion of a frame 1 of the printing apparatus. A guide shaft 3 and a guide rail 4 are supported by the frame 1 so as to extend parallel to the platen 2. A reversible type selection motor 6 is supported on the carriage 5, and a driving gear 7 is mounted on the shaft of the motor 6.

A rotating shaft 8 is rotatably supported on the carriage 5, extending at right angles to the axis of the platen 2. A type wheel 9, having a number of radial types 9*a*, and a driven gear 10 in mesh with the driving gear 7 are fixed to the rear end of the shaft 8 so as to be rotatable in one therewith. Arranged on the carriage 5, moreover, are a printing hammer 11 and a solenoid 12 for actuating the hammer 11 A ribbon cassette 13, containing a printing ribbon therein, is removably mounted on a holder (not shown) on the carriage, as indicated by a two-dot chain line in FIG. 1.

A pair of ribbon vibrators 14, which constitute part of the holder, will be described later.

When one of the input keys 21*a* on a keyboard 21, which is disposed at the front portion of the frame 1, is operated, the type selection motor 6 rotates correspondingly through a predetermined angle. As the motor 6 rotates in this manner, the type wheel 9 is rotated by means of the gears 7 and 10. Thereupon, a specified one of the types 9*a* corresponding to the operated input key is located selectively to a printing position which faces the platen 2. At the same time, the printing hammer 11 is actuated by the solenoid 12 to impact against the printing sheet on the platen 2, through the medium of the printing ribbon, for printing.

A type selection mechanism for the type wheel 9 and the operation thereof are conventional. At two opposite side portions of the carriage 5, the respective proximal ends of the ribbon vibrators 14, which constitute part of the holder, as mentioned before, and serve as ribbon supporting means, are supported by a rocking shaft 15. The vibrators 14 can rock in a body around an axis X—X of the shaft 15. As the ribbon vibrators 14 rock, a correction ribbon 16, which is stretched between the respective distal end portions of the vibrators 14, moves vertically, as indicated by an arrow, between an upper-side operative position indicated by a two-dot chain line and a lower-side nonoperative position indicated by a full line.

Figure 2:
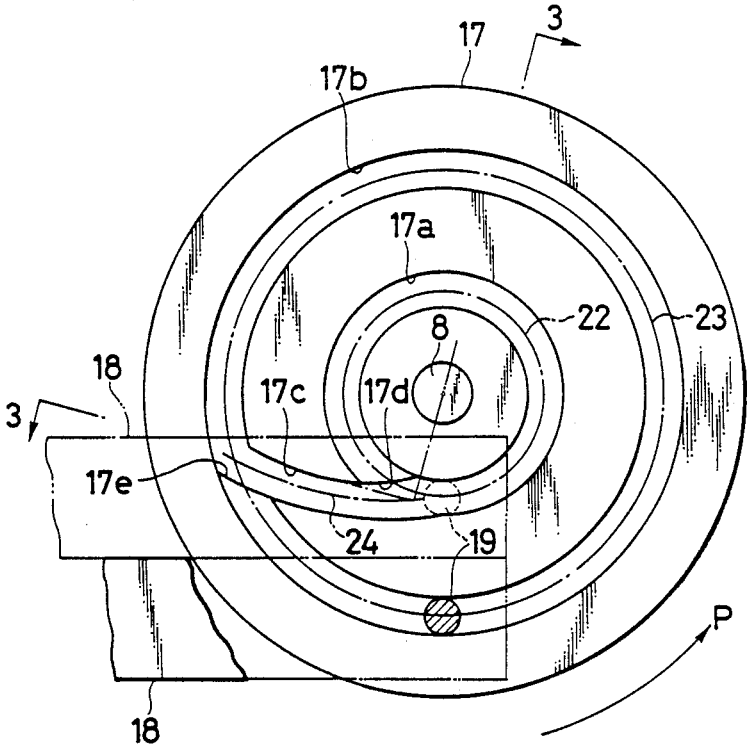
FIG. 2 is an enlarged plan view of a cam member of the printing apparatus shown in FIG. 1.

A disk-shaped cam member 17 is fixed to the front end of the rotating shaft 8. As shown in FIG. 2, inner and outer annular cam grooves 17*a* and 17*b* are formed on the front face of the cam member 17, extending individually along the circumferences of concentric circles around the axis of the shaft 8. The cam grooves 17*a* and 17*b* constitute second and third cam portions, respectively. A coupling cam groove 17*c*, which constitutes a first cam portion, extends at an angle to the radial direction of the cam member 17, between the cam grooves 17*a* and 17*b*. The groove 17*c* connects the grooves 17*a* and 17*b*. Circular lines 22 and 23, which extend along the respective center lines of the inner and outer annular cam grooves 17*a* and 17*b*, and a line 24, which extends along the center line of the coupling cam groove 17*c*, are indicated by dashed lines.

Figure 3:
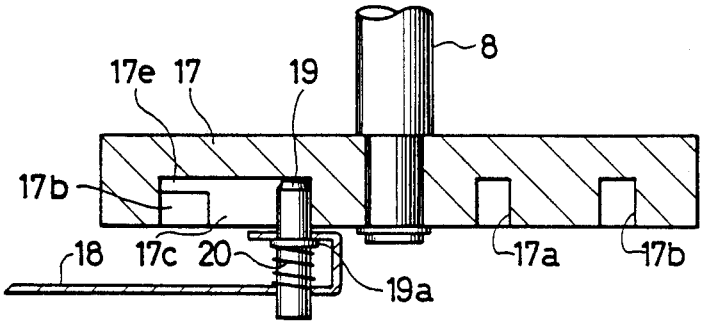
FIG. 3 is a sectional view of the cam member as taken along line 3—3 of FIG. 2.

An operating plate 18 protrudes substantially horizontally from one of the ribbon vibrators 14. A pin 19, which serves as a cam follower, is supported on the distal end of the operating plate 18 for axial movement. The pin 19 is adapted to engage one of the cam grooves 17*a* to 17*c* at the lower half portion of the cam member 17, that is, below the shaft 8. As shown in FIG. 3, the pin 19 is continually urged toward the inner part of the grooves 17*a* to 17*c* by a spring 20. A stopper 19*a*, which is formed integrally with the pin 19, is pressed against the operating plate 18 by the urging force of the spring 20. Thus, the pin 19 is always held in a position where it is fitted deep in one of the cam grooves 17*a* to 17*c*, as shown in FIG. 3.

Figure 4:
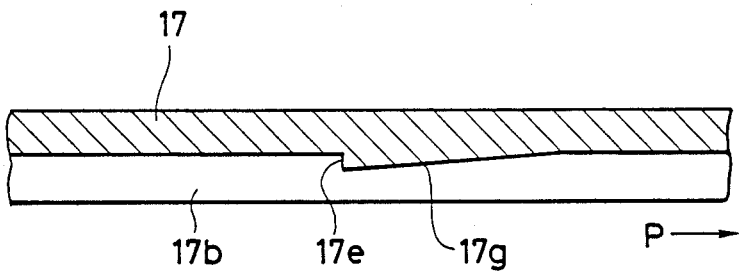
FIG. 4 is a developed sectional view of an outer annular cam groove of the cam member as taken along a circular center line thereof.
Figure 5:
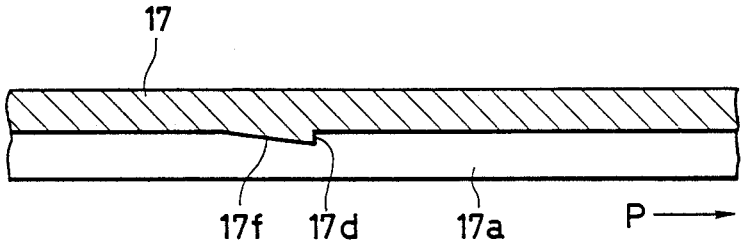
FIG. 5 is a developed sectional view of an inner annular cam groove of the cam member as taken along a circular center line thereof.

As shown specially in FIGS. 4 and 5, stepped walls 17*d* and 17*e* are formed at the bottom portions of the annular cam grooves 17*a* and 17*b*, respectively. When the cam member 17 is rotated in the direction opposite to the direction of arrow P of FIG. 2, the pin 19 in the outer cam groove 17*b* engages the stepped wall 17*e*, and is therefore guided compulsorily into the coupling cam groove 17*c*, and then into the inner cam groove 17*a* via the groove 17*c*. When the cam member 17 is rotated in the direction of arrow P, on the other hand, the pin 19 in the inner cam groove 17*a* engages the stepped wall 17*d*, and is therefore guided compulsorily into the coupling cam groove 17*c*, and then into the outer cam groove 17*b* via the groove 17*c*.

Partial slanting surfaces 17*f* and 17*g* are formed at the bottom portions of the cam grooves 17*a* and 17*b*, respectively. These surfaces 17*f* and 17*g* are restricted only to the areas of their corresponding stepped walls 17*d* and 17*c* which are located in the circular lines 22 and 23 of the cam grooves 17*a* and 17*b*, respectively. The remaining bottom portions of the grooves are of the same depth.

Thus, when the cam member 17 rotates in the direction of arrow P, with the pin 19 in the outer annular cam groove 17*b*, the pin 19 slides on the slanting surface 17*g* against the urging force of the spring 20, and runs past the stepped wall 17*c*. When the cam member 17 rotates in the opposite direction to arrow P, with the pin 19 in the inner annular cam groove 17*a*, the pin 19 slides on the slanting surface 17*f* against the urging force of the spring 20, and runs past the stepped wall 17*d*. In either case, the pin 19 is allowed to stay in the outer or inner cam groove 17*b* or 17*a*. Accordingly, the ribbon vibrators 14 are kept from rocking, so that the ribbon 16 is held in its down or up position.

During a normal printing operation of the printing apparatus, the pin 19 on the operating plate 18 is fitted in the outer annular cam groove 17*b* of the cam member 17, as indicated by the full line in FIG. 2. Thus, as the ribbon vibrators 14 rock downward, the correction ribbon 16 is situated in the nonoperative position. If one of the input keys 21*a* is operated, the type-selection motor 6 rotates in the direction of arrow Q of FIG. 1. As the motor 6 rotates in this manner, the type wheel 9 and the cam member 17 are rotated in the direction of arrow P, so that the specified type 9*a* is situated selectively in the printing position. Thereafter, the printing hammer 11 is actuated for printing.

In the printing operation, the type-selection motor 6 is rotated only in the direction of arrow Q, so that the cam member 17 rotates always in the direction of arrow P. Accordingly, the pin 19 of the operating plate 18 cannot be guided compulsorily by the stepped wall 17*e* as aforesaid. In other words, the pin 19 cannot be guided to the inner annular cam groove 17*a*. Consequently, the ribbon vibrators 14 remain in the nonoperative position.

When a correction key 21*b* on the keyboard 21 is operated, the type-selection motor 6 rotates in the opposite direction to arrow Q. As the motor 6 rotates in this manner, the type wheel 9 and the cam member 17 are rotated in the opposite direction to arrow P of FIG. 2. Thereupon, the pin 19 is guided compulsorily by the stepped wall 17*e*, and is moved from the outer annular cam groove 17*b* to the inner annular cam groove 17*a* through the coupling cam groove 17*c*. Accordingly, the operating plate 18 is moved up, as indicated by the two-dot chain line in FIG. 2, so that the ribbon vibrators 14 rock upward. Thus, the correction ribbon 16 is shifted to the operative position where it faces the platen 2, as indicated by the two-dot chain line in FIG. 1. If one of the input keys 21*a* is operated in this state, the type-selection motor 6 further rotates in the opposite direction to arrow Q, so that the type wheel 9 and the cam member are rotated in the opposite direction to arrow P. After the specified type 9*a* is situated selectively in the printing position, the printing hammer 11 is actuated. In this manner, a character or the like on the printing sheet is erased through the medium of the correction ribbon 16.

In the correcting operation, the type-selection motor 6 is rotated only in the opposite direction to arrow Q, so that the cam member 17 rotates always in the opposite direction to arrow P. Accordingly, the pin 19 of the operating plate 18 cannot be subjected to the compulsory guiding action of the stepped wall 17*d*. In other words, the pin 19 cannot be guided to the outer annular cam groove 17*b*. Consequently, the ribbon vibrators 14 remain in the operative position.

After the correcting operation is finished, the type-selection motor 6 rotates in the direction of arrow Q, so that the type wheel 9 and the cam member 17 are rotated in the direction of arrow P. Thereupon, the pin 19 on the operating plate 18 is guided compulsorily by the stepped wall 17*d*, and is moved relatively from the inner annular cam groove 17*a* to the outer annular cam groove 17*b* through the coupling cam groove 17*c*. As the ribbon vibrators 14 rock downward, the correction ribbon 16 is situated in the nonoperative position. In this state, type selection and hammering for the normal printing operation are performed.

Although an illustrative embodiment of the present invention has been described in detail herein, the invention is not limited to that precise embodiment, and various modifications may be effected therein as follows.

In contrast with the case of the above described embodiment, for example, the printing apparatus may be arranged so that the correction ribbon 16 is situated in the lower-side nonoperative position when the pin 19 on the operating plate 18 is fitted in the inner annular cam groove 17*a* on the cam member 17, and that the ribbon 16 is situated in the upper-side operative position when the pin 19 is fitted in the outer annular cam groove 17*b*. This arrangement can be obtained by only locating the operating plate 18 corresponding to the upper half portion of the cam member 17 so that the pin 19 engages that portion of the annular cam groove 17*a* or 17*b* situated above the central axis of the shaft 8.

Alternatively, a cam surface may be provided on the outer periphery of the cam member so that the ribbon vibrators 14 are rocked up and down by the action of the cam surface.

In the aforementioned embodiment, moreover, the rotating direction of the type-selection motor 6 in the printing or correcting operation is limited to one direction. Alternatively, however, the motor 6 may be controlled reversibly without causing the pin 19 to move to the other annular cam groove, in the type selection for the printing or correcting operation.

Further, the ribbon cassette containing the printing ribbon may be arranged so as to be rocked vertically along with the correction ribbon by the action of the cam member. In the normal printing operation, moreover, the type selection may alternatively be performed after the printing ribbon is moved to its printing position by the cam member 17. In this case, the correction ribbon is held in its nonprinting position during the type selection.

Furthermore, a multicolor or multistage printing ribbon may be arranged so a to rock vertically.

It is to be understood that the present invention is not limited to the embodiment and modifications described above, and that various changes and other modifications may be effected therein by one skilled in the art without departing from the scope or spirit of the invention.

What is claimed is:

1. A printing apparatus comprising;

a type wheel;

reversibly rotational drive means for rotating the type wheel for the type selection;

ribbon supporting means supporting a ribbon and movable to shift the ribbon between the first and second positions;

cam means including first, second and third cam portions selectively rotatable in either of one and the other directions by the rotational drive means; and coupling means for operatively connecting the ribbon supporting means and the cam means, said first cam portion of the cam means engaging the coupling means so as to cause the ribbon supporting means, in conjunction with the coupling means, to move the ribbon toward the first position, as the cam means rotates in one direction, and to move the ribbon toward the second position, as the cam means rotates in the other direction, said second cam portion of the cam means engaging the coupling means so as to cause the ribbon supporting means, in conjunction with the coupling means, to hold the ribbon in the first position, as the cam means continues to rotate in said one direction, while allowing the rotational drive means to select types of the type wheel, and said third cam portion of the cam means engaging the coupling means so as to cause the ribbon supporting means, in conjunction with the coupling means, to hold the ribbon in the second position, as the cam means continues to rotate in the other direction, while allowing the rotational drive means to select types of the type wheel.

2. The printing apparatus according to claim 1, wherein second cam portion of the cam means is formed along the circumference of a circle concentric with the axis of rotation of the cam means, and said first cam portion of the cam means is formed along a line having one end connected, at a first coupling portion, to the second cam portion, said line extending aslant the radial direction of the cam means.

3. The printing apparatus according to claim 1, wherein said ribbon is a correction ribbon, said first position is an operative position for correction operation and said second position is a non-operative position.

4. The printing apparatus according to claim 3, wherein said second cam portion of the cam means is formed along the circumference of a circle concentric with the axis of rotation of the cam means, and said first cam portion of the cam means is formed along a line having one end connected, at a first coupling portion, to the second cam portion, said line extending aslant the radial direction of the cam means.

5. The printing apparatus according to claim 4, wherein said third cam portion of the cam means is formed along the circumference of a circle, concentric with and separate from the second cam portion, and said first cam portion of the cam means has the other end connected, at a second coupling portion, to the third cam portion.

6. The printing apparatus according to claim 5, wherein said coupling means includes a cam follower alternatively engaging one of the first, second, and third cam portions of the cam means; said first coupling portion between the first and second cam portions of the cam means is provided with the first guide means, adapted to compulsorily guide the cam follower from the second cam portion to the first cam portion when the cam means rotates in one direction, and to allow the cam follower to continuously engage the second cam portion when the cam means rotates in the other direction; and said second coupling portion between the first and third cam portions of the cam means is provided with a second guide means, adapted to compulsorily guide the cam follower from the third cam portion to the first cam portion when the cam means rotates in said other direction, and to allow the cam follower to continuously engage the third cam portion when the cam means rotates in said one direction.

7. The printing apparatus according to claim 6, wherein said first, second, and third cam portions of the cam means are each formed of a cam groove, said first guide means is composed of a first stepped wall formed at the groove bottom between the first and second cam portions, and said second guide means is composed of a second stepped wall formed at the groove bottom between the first and third portions.

8. The printing apparatus according to claim 1, wherein said rotational drive means is a reversible single drive motor.

9. The printing apparatus according to claim 8, wherein said ribbon supporting means includes a ribbon vibrator having one end portion pivotally mounted for rocking motion around an axis and holding the ribbon on the other end portion thereof, and said coupling means has one end fixed to the ribbon vibrator and the other end extending toward the cam means, said other end of the coupling means having a cam follower alternatively engaging the first or second cam portion of the cam means.

10. The printing apparatus according to claim 9, further comprising an elongated platen facing the type wheel and a rotating shaft fitted, on one end portion thereof, with the type wheel and, on the other end portion, with the cam means, said rotating shaft extending substantially at right angles to the platen and serving to rotate the cam means along with the type wheel.

11. The printing apparatus according to claim 10, further comprising a carriage carrying thereon and serving to reciprocate, substantially parallel to the platen, the type wheel, cam means, ribbon vibrator, and type-selection drive motor.

12. A printing apparatus comprising:

a type wheel;

rotational drive means for rotating the type wheel for type selection;

ribbon supporting means supporting a correction ribbon and movable between first and second positions so that the ribbon is moved between a printing position and a nonprinting position;

cam means including first, second and third cam portions and rotated by the rotational drive means, said first cam portion of the cam means being formed along a line having one end connected, at a first coupling portion, to the second cam portion, and the other end connected, at a second coupling portion, to the third cam portion, said line extending aslant the radial direction of the cam means, said second cam portion of the cam means being formed along the circumference of a circle concentric with the axis of rotation of the cam means, and said third cam portion of the cam means being formed along the circumference of circle, concentric with and separate from the second cam portion; and coupling means for operatively connecting the ribbon supporting means and the cam means, said first cam portion of the cam means engaging the coupling means so as to cause, in conjunction with the coupling means, the ribbon supporting means to move to the first position, as the cam rotates, thereby moving the ribbon from the nonprinting position to the printing position, said second cam portion of the cam means engaging the coupling means so as to hold, in conjunction with the coupling means, the ribbon supporting means in the first position, as the cam means rotates, thereby allowing the rotational drive means to select types of the type wheel, with the ribbon held in the printing position, and said third cam portion of the cam means engaging the coupling means so as to hold, in conjunction with the coupling means, the ribbon supporting means in the second position, as the cam rotates, thereby allowing the rotational drive means to select the types of the type wheel, with the ribbon held in the nonprinting position.

13. The printing apparatus according to claim 12, wherein said coupling means includes a cam follower alternatively engaging one of the first, second, and third cam portions of the cam means; said first coupling portion between the first and second cam portions of the cam means is provided with first guide means, adapted to compulsorily guide the cam follower from the second cam portion to the first cam portion when the cam means rotates on one direction, and to allow the cam follower to continuously engage the second cam portion when the cam means rotates in the other direction; and said second coupling portion between the first and third cam portions of the cam means is provided with second guide means, adapted to compulsorily guide the cam follower from the third cam portion to the first cam portion when the cam means rotates in said other direction, and to allow the cam follower to continuously engaged the third cam portion when the cam means rotates in said one direction.

14. The printing apparatus according to claim 13, wherein said first, second, and third cam portions of the cam means are each formed of a cam groove, said first guide means is composed of a first stepped wall formed at the groove bottom between the first and second cam portions, and said second guide means is composed of a second stepped wall formed at the groove bottom between the first and third portions.

15. A printing apparatus comprising:

a type wheel;

a single drive motor for rotating the type wheel for type selection;

ribbon supporting means supporting a ribbon and movable between first and second positions so that the ribbon is moved between a printing position and a nonprinting position, said ribbon supporting means including a ribbon vibrator having two end portions, one end portion being pivotably mounted for rocking motion around an axis and holding the ribbon on the other end portion thereof;

cam means including first and second cam portions rotated by the rotational drive means;

coupling means for operatively connecting the ribbon supporting means and the cam means, said coupling means having one end fixed to the ribbon vibrator and the other end extending toward the cam means, said other end of the coupling means having a cam follower alternatively engaging the first or second cam portion of the cam means; and an elongated platen facing the type wheel and a rotating shaft fitted, on one end portion thereof, with the type wheel and, on the other end portion, with the cam means, said rotating shaft extending substantially at right angles to the platen and serving to rotate the cam means along with the type wheel, said first cam portion of the cam means engaging the coupling means so as to cause, in conjunction with the coupling means, the ribbon supporting means to move to the first position, as the cam means rotates, thereby moving the ribbon from the non-printing position to the printing position, and said second cam portion of the cam means engaging the coupling means so as to hold, in conjunction with the coupling means, the ribbon supporting means in the first position, as the cam means rotates, thereby allowing the rotational drive means to select types of the type wheel, with the ribbon held in the printing position.

16. The printing apparatus according to claim 15, further comprising a carriage carrying thereon and serving to reciprocate, substantially parallel to the platen, the type wheel, cam means, ribbon vibrator, and type-selection drive motor.

* * * * *